US006742189B2

(12) United States Patent
Bennett

(10) Patent No.: US 6,742,189 B2
(45) Date of Patent: Jun. 1, 2004

(54) COLLAPSIBLE CHILDREN'S BIB AND METHOD OF MAKING SAME

(76) Inventor: Julie Bennett, 35 Fawnridge Pl., Aliso Viejo, CA (US) 92656

( * ) Notice: Subject to any disclaimer, the term of this patent is extended or adjusted under 35 U.S.C. 154(b) by 19 days.

(21) Appl. No.: 10/256,514

(22) Filed: Sep. 26, 2002

(65) Prior Publication Data

US 2004/0060092 A1 Apr. 1, 2004

(51) Int. Cl.[7] ..... A41B 13/10
(52) U.S. Cl. ..... 2/49.2; 2/49.1
(58) Field of Search ..... 2/48, 49.2, 49.1, 2/46, 49.3, 49.4, 49.5, 50, 51, 52, 102, 106, 115, 104, 92, 94, 69, 69.5, 247, 254, 253, 250; 206/581, 216, 38, 278, 282, 299; 224/575, 576, 577, 257

(56) References Cited

U.S. PATENT DOCUMENTS

| | | | | | |
|---|---|---|---|---|---|
| 1,135,833 | A | * | 4/1915 | Morse | 2/48 |
| 1,797,208 | A | * | 3/1931 | Weisz | 2/51 |
| 1,979,879 | A | * | 11/1934 | Harris | 2/48 |
| 2,164,369 | A | * | 7/1939 | Woolever | 2/49.1 |
| 2,364,258 | A | * | 12/1944 | Wallace | 2/92 |
| 2,389,596 | A | * | 11/1945 | Charnas et al. | 224/623 |
| 2,607,040 | A | * | 8/1952 | Zaleski | 2/51 |
| 2,846,685 | A | * | 8/1958 | Ehrich | 2/51 |
| 4,071,921 | A | * | 2/1978 | Jury | 15/227 |
| 5,025,501 | A | * | 6/1991 | Dillon | 2/51 |
| 5,244,278 | A | * | 9/1993 | Robitaille | 383/4 |
| 5,410,758 | A | * | 5/1995 | Dupont et al. | 2/51 |
| 5,483,701 | A | * | 1/1996 | Ferreyros | 2/49.2 |
| 5,918,311 | A | * | 7/1999 | Lampson et al. | 2/49.2 |
| 5,960,471 | A | * | 10/1999 | Burton | 2/48 |
| 5,960,472 | A | * | 10/1999 | Reid | 2/48 |
| 6,000,056 | A | * | 12/1999 | Brady et al. | 2/49.1 |
| 6,141,798 | A | | 11/2000 | Manning | 2/49.1 |
| 6,334,220 | B1 | * | 1/2002 | Frye | 2/49.2 |

OTHER PUBLICATIONS www.rightstart.com (The Right Start—Babies to 2 Years, Super Bibs 3 Pack, Long SleeveToddler Super Bib) (As of Jun. 20, 2002).
www.bumkins.com (Browse Bumkins site, Waterproof Bibs, Sleeved Bib) (As of Jun. 20, 2002).
The Right Start Product Catalog, p. 43, Spring 2002.

* cited by examiner

*Primary Examiner*—Amy B. Vanatta
(74) *Attorney, Agent, or Firm*—Stetina Brunda Garred & Brucker

(57) ABSTRACT

A bib for preventing soil-causing fragments from soiling a garment worn upon a wearer's body. The bib comprises a body-engaging member configured to engage the wearer's body for preventing the soil-causing fragments from soiling the garment worn thereupon. This body-engaging member has upper and lower body regions. A first pouch is formed about the lower body region and is openable towards the upper body region for capturing the soil-causing fragments. Furthermore, a second pouch is formed about the lower body region over the first pouch and is openable away from the upper body region. The second pouch is receivable of the upper body region when folded and deposited thereinto so as to contain the soil-causing fragments and the soiling caused thereby within the bib.

20 Claims, 3 Drawing Sheets

COLLAPSIBLE CHILDREN'S BIB AND METHOD OF MAKING SAME

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present, invention relates generally to bibs for infants and small children, and more particularly to an improved bib which is adapted to be collapsible after use for containing any soil-causing fragments (e.g., food fragments) and soiling caused thereby within the bib.

It is a common practice for a parent to employ the use of a bib to prevent the garment of his or her infant and/or small child from becoming soiled. Indeed, various types of children's bibs are currently available from manufacturers of infant products. Though such currently known and available children's bibs achieve their primary objective of protecting an infant's and/or small child's garment, they possess certain deficiencies which detract from their overall utility.

Perhaps the greatest deficiency of the prior art children's bibs is their inability to fully contain the soiling after being used. Specifically, soil-causing fragments such as excess food fragments tend to scatter all over the surrounding areas once the bib is taken off. Additionally, the soiling caused by such fragments upon the bib oftentimes smear or rub off the child's garments, ultimately defeating the purpose of even wearing the bib in the first place. Even worse, such soiling may further contaminate the immediate areas surrounding the child which may undesirably lead to permanent marring of furniture, carpets and the like.

Another deficiency exists in that elastic strings and/or draw strings are typically used around a child's neck area to apply the prior art bibs upon the child. This may lead to dire consequences such as choking the child due to the contraction of the elastic strings and/or draw strings. In this respect, the use of these strings pose a dangerous and unnecessary risk to the child who is typically unable to fully appreciate the consequences resulting from such risk.

Further deficiency characterizing the prior art children's bib is their lack of ability to be quickly and conveniently applied upon the infant and/or small child. Typically, the parent must apply the bib through the child's head and arms first only to engage it tautly from the back. This may prove to be very laborious for the parent as the child typically tends to become agitated and thus squirm considerably when the parent attempts to put the bib on. As such, the parent may find the bib to be more of an inconvenience rather than a relief, especially when it is used multiple times throughout the day.

Another deficiency exists in the prior art where bibs using elastic wrists are not adjustable to the size of the child's wrist which thereby causes fluids to seep into the sleeves and soils the underlying clothes.

In view of the above-described shortcomings of conventional children's bibs, there exists a need in the art for a bib which can rapidly and easily contain soil-causing fragments (e.g., food fragments) and soiling caused thereby after its use. Further, there exists a need in the art for a bib which can be conveniently and quickly applied upon the child while it is safe to use by being risk-free of choking the child.

BRIEF SUMMARY OF THE INVENTION

In accordance with a preferred embodiment of the present invention, there is provided a bib for preventing soil-causing fragments from soiling a garment worn upon a wearer's body. The bib comprises a body-engaging member configured to engage the wearer's body for preventing the soil-causing fragments from soiling the garment worn thereupon. This body-engaging member has upper and lower body regions. A first pouch is formed about the lower body region and is openable towards the upper body region for capturing the soil-causing fragments. Furthermore, a second pouch is formed about the lower body region over the first pouch and is openable away from the upper body region. The second pouch may receive the upper body region when folded and deposited thereinto so as to contain the soil-causing fragments and the soiling caused thereby within the bib.

The body-engaging member is preferably fabricated from a water-resistant material. The water-resistant material may be fabric. The body-engaging member also comprises two opposing side body portions each having a sleeve extending away therefrom. The sleeves each define a sleeve end with a sleeve opening wherein each of the sleeve ends may have a hook-and-loop fastener for adjusting the respective sleeve opening. Further, a neck-cutout is formed about the upper body region between the two opposing side body portions.

In the present invention, the body-engaging member comprises two substantially identical back body pieces forming a back body portion thereof when engaged to each other. The back body pieces each have an upper back flap extending away therefrom. The back body pieces form a back opening therebetween when the upper back flaps are extended toward and engaged with each other. Each of the upper back flaps may comprise a hook-and-loop fastener so as to be adjustably engaged with each other.

In the preferred embodiment of the present invention, the first and second pouches are each preferably fabricated from a material identical to that of the body-engaging member. Additionally, the first and second pouches preferably extend across the lower body region between the two opposing side body portions. The second pouch is adapted to open in an opposite direction than the first pouch. The soil-causing fragments may be food fragments.

In accordance with a preferred embodiment of the method of the present invention, there is provided a method of protecting a garment worn upon a wearer's body. Such method comprises the step of first engaging a bib with upper and lower body regions upon the garment worn on the wearer's body. The next step is to define a first pouch formed about the lower body region and which is sized and configured to open towards the upper body region. Similarly, a second pouch which is formed about the lower body region over the first pouch is also defined. The second pouch is sized and configured to open away from the upper body region.

The method further features the steps of preventing soil-causing fragments from soiling the garment with the bin and capturing the soil-causing fragments with the first pouch. Thereafter, the bib is disengaged from the garment wherein the upper body region is folded towards the second pouch. Lastly, the method comprises the step of depositing the folded upper body region into the second pouch to contain the soil-causing fragments and the soiling caused thereby within the bib.

In accordance with a preferred embodiment of the method of the present invention, there is provided a method of manufacturing a bib. Such method first comprises the step of obtaining a template having upper and lower template regions. The method also comprises the step of forming a first longitudinal template region, and further a second longitudinal template region having a peripheral geometry similarly sized and configured as the first longitudinal template region when superimposed thereupon. The next step includes defining an inner template portion, an outer template portion, an intermediate template portion and a hem template portion about the lower template region. The outer template portion is placed over the inner template portion.

Subsequently thereafter, the intermediate template portion and the hem template portion are placed underneath the outer template portion. The method then comprises the step of superimposing the upper and lower template regions with each other. Lastly, the method comprises the step of engaging the respective peripheral geometries of the first and second longitudinal template regions to manufacture the bib.

BRIEF DESCRIPTION OF THE DRAWINGS

These as well as other features of the present invention will become more apparent upon reference to the drawings wherein.

DETAILED DESCRIPTION OF THE INVENTION

Figures 1, 2, 3:
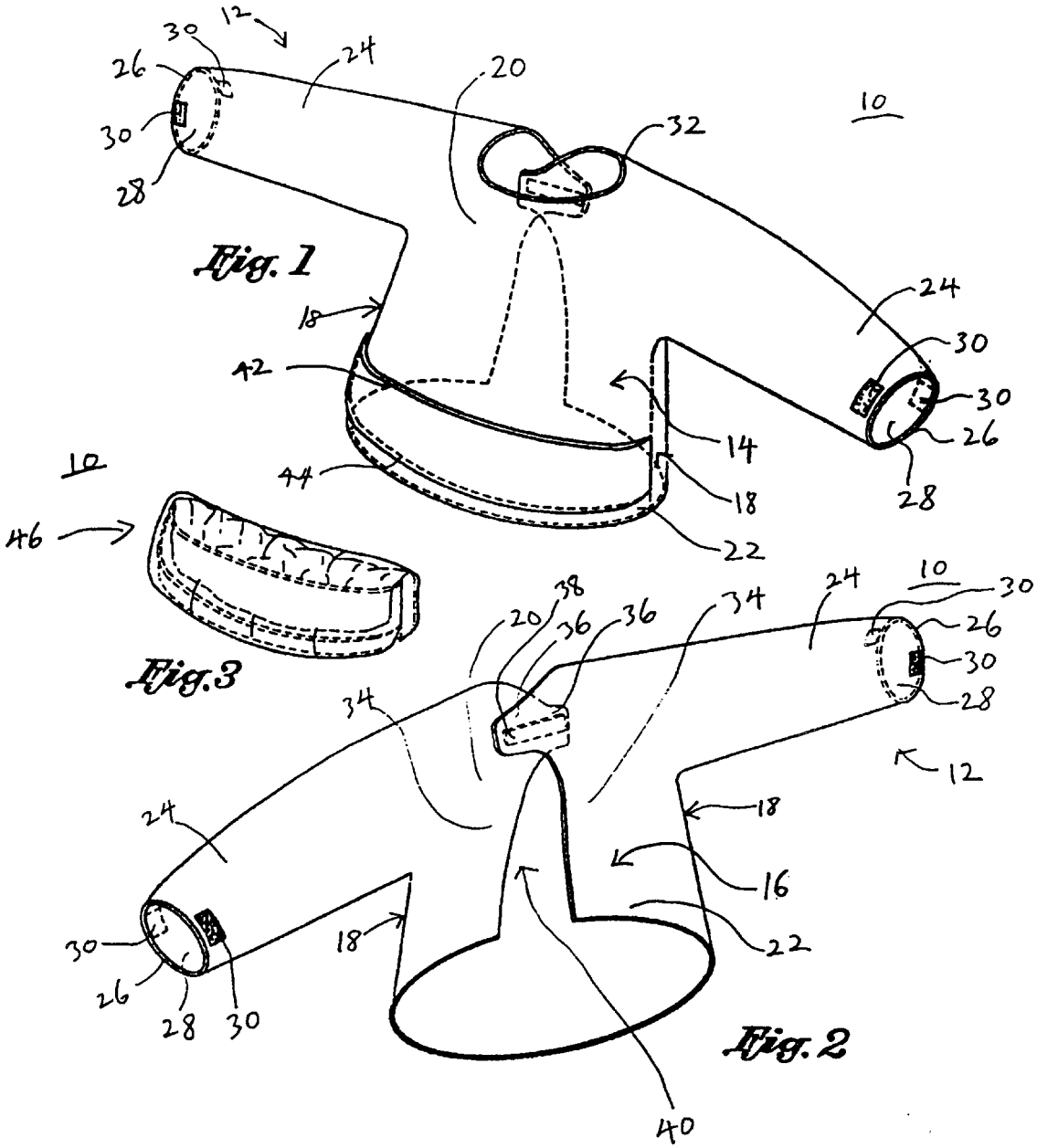
FIG. 1 is a front view of a bib constructed in accordance with a preferred embodiment of the present invention and illustrating its first and second pouches formed thereupon.
FIG. 2 is a rear view of the bib of FIG. 1 and illustrating its two upper back flaps which are adapted to adjustably engage with each other.
FIG. 3 is a front view of the bib of FIG. 1 and illustrating its transition into a collapsed state which is formed by folding and depositing an upper body region thereof into the second pouch.

Referring now to the drawings wherein the showings are for purposes of illustrating preferred embodiments of the present invention only, and not for purposes of limiting the same, FIG. 1 illustrates a bib 10 constructed in accordance with a preferred embodiment of the present invention. Among other advantages which will be discussed below, the bib 10 of the present invention is adapted to be collapsible after use so as to easily and quickly contain soil-causing fragments (e.g., food fragments) and soiling caused thereby within the bib 10. By doing so, the bib 10 is able to protect the garment of its wearer (i.e., infant and/or small child) and its immediate surroundings (e.g., carpets, furniture and the like) from becoming contaminated.

Referring more particularly to FIGS. 1 and 2, the bib 10 comprises a body-engaging member 12 configured to engage a wearer's body for preventing soil-causing fragments from soiling the garment worn thereupon. Although the body-engaging member 12 is shaped in the form of a long-sleeve article of clothing (i.e., jacket, sweater), it is expressly contemplated herein that the body-engaging member 12 may take the form of a short-sleeve clothing (e.g., T-shirt, vest and the like). Preferably this body-engaging member 12 is fabricated from a water-resistant material such as water-treated fabric (e.g., nylon). However, a person of ordinary skill in the art will recognize that other types of materials such as flexible plastic may be used in lieu thereof.

The body-engaging member 12 defines a front body portion 14, a back body portion 16 and two opposing side body portions 18. The body-engaging member 14 is further dividable into an upper body region 20 and a lower body region 22. Extending outwardly from each of the two opposing side body portions 18 about the upper body region 20 is a sleeve 24 which is used for accommodating the wearer's arm. Each of the sleeves 24 have a sleeve end 26 which is distally located from their point of extension. The sleeve ends 26 form sleeve openings 28 in which the wearer's hands may protrude therethrough.

The sleeve openings 28 may be selectively adjusted by a hook-and-loop fastener 30 situated adjacent each of the sleeve ends 26. In this regard, the sleeve ends 26 may be tightly adjusted around the wearer's wrist to prevent soil-causing fragments such as liquids (e.g., milk, juice, baby food, etc.) from dripping into the sleeve openings 28 and soiling the garment. Alternatively, they may be loosely adjusted through the use of their respective hook-and-loop fasteners 30 in order to provide comfort to the wearer. However, although the use of hook-and-loop fasteners 30 is preferred, one of ordinary skill in the art will appreciate that other fastening mechanisms such as eye-bolt fasteners, snap-tab fasteners, hooking fasteners and the like may also be used.

The body-engaging member 12 is provided with a neck-cutout 32 which is formed about the upper body region 20 between the two opposing side body portions 18. The neck-cut 32 essentially provides a sufficient opening for accommodating the wearer's neck. It should be noted herein that such neck-cutout 32 is simply formed by cutting out a respective portion of the body-engaging member 12, and does not use any other means such as elastic and/or draw strings for securement to the wearer's neck. By such configuration, any risks associated with choking of the wearer's neck are resolved hereby.

Referring now to FIG. 2 only, the body-engaging member 12 includes two back body pieces 34. Preferably, the back body pieces 34 are substantially identical in configuration and constitute to be the back body portion 16 of the body-engaging member when they are engaged with each other. More specifically, the back body pieces 34 each have an upper back flap 36 about the upper body region 20. The upper back flaps 36 are configured to extend inwardly toward each other away from their respective back body pieces 34. Due to this inward extension, the engagement between the two upper back flaps 36 can be greatly facilitated whereby the bib 10 may be applied quickly and conveniently upon the wearer. A hook-and-loop fastener 38 is preferably used between the upper back flaps 36 for adjustably engaging the upper back flaps 36 together. However, it should be noted that other fastening mechanisms such as eye-bolt fasteners, snap-tab fasteners, hooking fasteners and the like may be used instead of the hook-and-loop fastener 38.

Engaging the two upper back flaps 36 together results in a back opening 40 from a location of such engagement to the lower body region 22. The formation of the back opening 40 allows the lower body region 22 of the body-engaging member 12 to be loosely retained about the wearer's body. As such, the lower body region 22 may be selectively adjusted in length to protect down to the wearer's waist or knees.

Referring now back to FIG. 1, a first pouch 42 is formed about the lower body region 22 of the body-engaging member 12. More particularly, the first pouch 42 is preferably extended across the lower body region 22 between the two opposing side body portions 18. The first pouch 42 is formed, that is, preferably stitched in a manner as to be able to open with respect to the upper body region 20. By being openable towards the upper body region 20, the first pouch 42 is allowed to capture the soil-causing fragments when fallen thereinto. Preferably, the first pouch 42 is formed from the same material which was used to manufacture the body-engaging member 12 (e.g., water-resistant material).

In addition to the first pouch 42, a second pouch 44 is formed about the lower body region 22 of the body-engaging member 12. More specifically, the second pouch 44 is formed in a manner as to be positioned over the first pouch 42. Similar to the first pouch 42, the second pouch 44 is preferably extended across the lower body region 22 between the two opposing side body portions 18. However, unlike the first pouch 42, the second pouch 44 is formed so that it opens away from the upper body region 20, preferably opens in a direction opposite to which the first pouch 42 opens. The second pouch 44 is also preferably formed from the same material as the body-engaging member 12 (e.g., water-resistant material).

Referring now to FIGS. 1–3, the bib 10 of the present invention may transition into a collapsed state 46 subsequent to being used (best shown in FIG. 3). After being contaminated by soil-causing fragments such as food fragments for example, the bib 10 is taken off the wearer and formed into the collapsed state 46 so as to contain such fragments and the soiling caused thereby. In particular, the sleeves 24 are first folded inward upon the front body portion 14 of the body-engaging member 12. Then, the upper body region 20 of the body-engaging member 12 (along with the folded sleeves 24) is folded with respect to the lower body region 22 or the first pouch 42 towards the back body portion 16. The folded upper body region 20 is thereafter inserted into the second pouch 44. Essentially, the second pouch 44 receives and maintains the upper body region 20 when it is folded and deposited thereinto. Because the soiling is mainly caused on the front body portion 14, it may be sufficiently contained within the bib 10 by forming the collapsed state 46.

FIGS. 4–6*a* illustrate the manner of how the bib 10 of the present invention is manufactured. In order to make the present bib 10, a one-piece template 48 is first obtained. This template 48 is defined by an upper template region 50 and a lower template region 52. The one-piece template 48 is preferably cut so as to form a first longitudinal template region 54, and further a second longitudinal template region 56 which defines a peripheral geometry 58 similarly sized and configured as the first longitudinal template region 54 when superimposed thereupon. Notably, the peripheral geometries 58 of the first and second longitudinal template regions 54, 56 define sleeve template portions 55 and flap template portions 57 which eventually become sleeves 24 and upper back flaps 36 of the bib 10, respectively.

Figure 4:
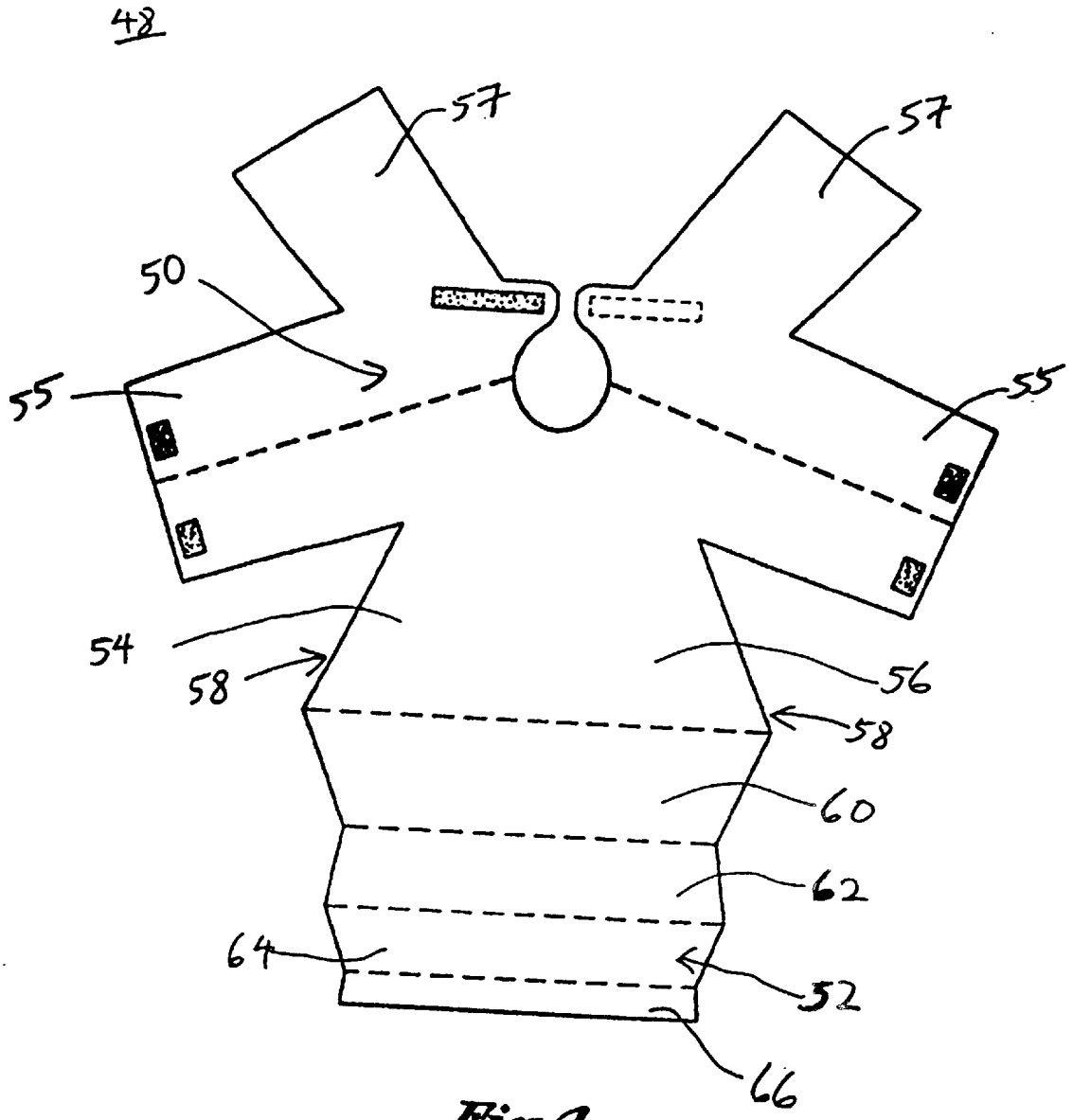
FIG. 4 is a front view of a cut-out template which is ultimately manufactured into the bib of FIG. 1.
Figure 5:
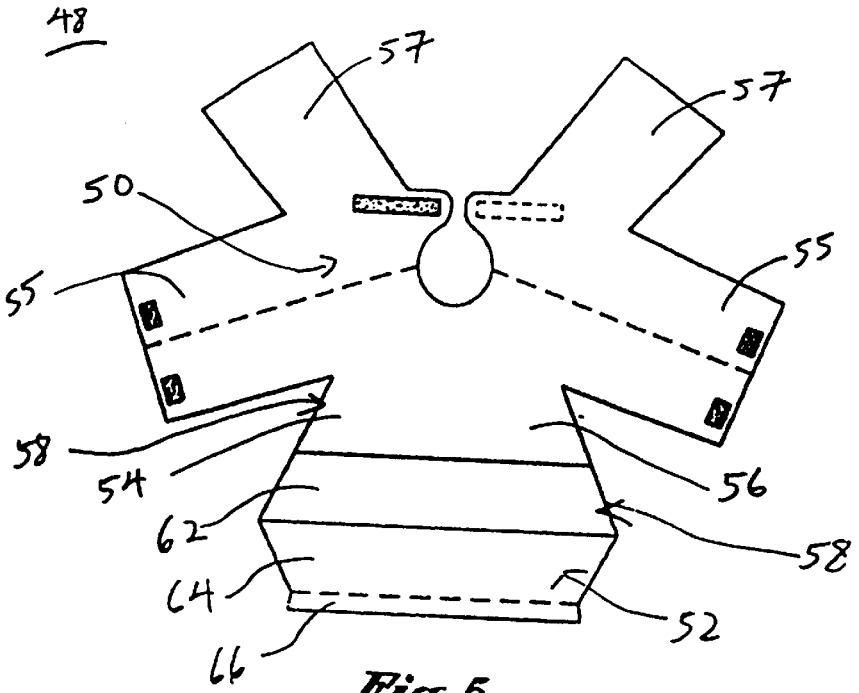
FIG. 5 is a front view of the cut-out template of FIG. 4 and illustrating its outer template portion which is placed over its inner template portion.
Figure 5A:
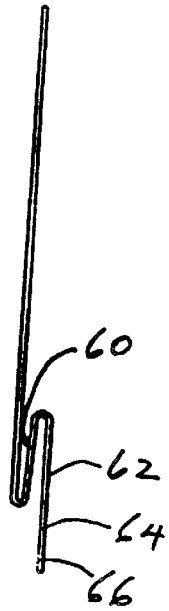
FIG. 5*a* is a partial cross-sectional view of the cut-out template of FIG. 5 and illustrating the positioning of the outer template portion with respect to the inner template portion.
Figure 6:
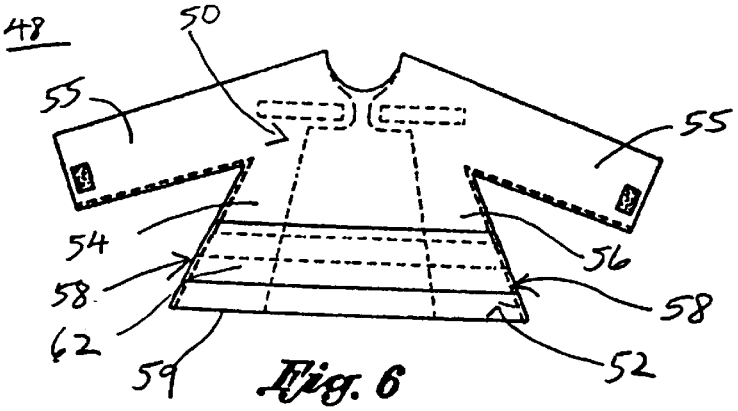
FIG. 6 is a front view of the cut-out template of FIG. 5 and illustrating its intermediate template portion and hem template portion which are placed underneath the outer template portion.
Figure 6A:
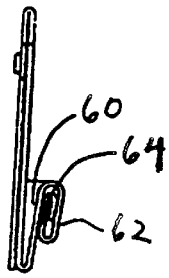
FIG. 6*a* is a partial cross-sectional view of the cut-out template of FIG. 6 and illustrating the positioning of the intermediate template portion and the hem template portion with respect to the outer template portion.

About the lower template region 52 of the one-piece template 48, there is defined in the sequential order going towards the bottom end 59 of the lower template region 52 (preferably via marking) an inner template portion 60, an outer template portion 62, an intermediate template portion 64 and a hem template portion 66 (best shown in FIG. 4). The outer template portion 62 is folded over the inner template portion 60 (shown in FIGS. 5 and 5*a*). Such arrangement will eventually result in the formation of the first pouch 42. Then, the intermediate template portion 64 and the hem template portion 66 are folded immediately underneath the outer template portion 62 and selectively stitched thereto to maintain such positioning (shown in FIGS. 6 and 6*a*). This ultimately results in the formation of the second pouch 44.

Thereafter, the upper and lower template regions 50, 52 are folded with respect to each other. After being folded together, the peripheral geometries 58 of the first and second longitudinal template regions 54, 56 are stitched to engage the upper and lower template regions 50, 52 together. More precisely, stitching is performed longitudinally along the peripheral geometries 58 from about the bottom end 59 of the lower template region 52 to about the sleeve template portion 55, thus forming the bib 10 of the present invention.

Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

What is claimed is:

1. A bib for preventing soil-causing fragments from soiling a garment worn upon a wearer's body, the bib comprising:

a body-engaging member configured to engage the wearer's body for preventing the soil-causing fragments from soiling the garment worn thereupon, the body-engaging member having upper and lower body regions;

a first pouch formed about the lower body region and being openable towards the upper body region for capturing the soil-causing fragments; and a second pouch formed about the lower body region over the first pouch and being openable away from the upper body region, the second pouch being receivable of the upper body region when folded and deposited thereinto so as to contain the soil-causing fragments and the soiling caused thereby within the bib.

2. The bib of claim 1 wherein the body-engaging member is fabricated from a water-resistant material.

3. The bib of claim 2 wherein the water-resistant material is fabric.

4. The bib of claim 1 wherein the body-engaging member comprises:

two opposing side body portions each having a sleeve extending away therefrom; and a neck-cutout formed about the upper body region between the two opposing side body portions.

5. The bib of claim 4 wherein each of the sleeves define a sleeve end with a sleeve opening, each of the sleeve ends having a hook-and-loop fastener for adjusting the respective sleeve opening.

6. The bib of claim 1 wherein the body-engaging member comprises two substantially identical back body pieces forming a back body portion thereof when engaged to each other.

7. The bib of claim 6 wherein the back body pieces each have an upper back flap extending away therefrom, the back body pieces forming a back opening therebetween when the upper back flaps are extended toward and engaged with each other.

8. The bib of claim 7 wherein each of the upper back flaps comprise a hook-and-loop fastener so as to be adjustably engaged with each other.

9. The bib of claim 1 wherein the first and second pouches are each fabricated from a material identical to that of the body-engaging member.

10. The bib of claim 1 wherein the body-engaging member comprises two opposing side body portions, the first and second pouches extending across the lower body region between the two opposing side body portions.

11. The bib of claim 1 wherein the second pouch opens in an opposite direction than the first pouch.

12. The bib of claim 1 wherein the soil-causing fragments are food fragments.

13. A method of protecting a garment worn upon a wearer's body, the method comprising the steps of:

a) engaging a bib with upper and lower body regions upon the garment worn on the wearer's body;

b) defining a first pouch formed about the lower body region and being sized and configured to open towards the upper body region;

c) defining a second pouch formed about the lower body region over the first pouch and being sized and configured to open away from the upper body region;

d) preventing soil-causing fragments from soiling the garment with the bib;

e) capturing the soil-causing fragments with the first pouch;

f) disengaging the bib from the garment;

g) folding the upper body region towards the second pouch; and h) depositing the folded upper body region into the second pouch to contain the soil-causing fragments and the soiling caused thereby within the bib.

14. The method of claim 13 wherein step a) comprises:

1) defining two opposing side body portions of the bib and two substantially identical back body pieces forming a back body portion thereof;

2) placing a neck-cutout formed about the upper body region between the two opposing side body portions upon the wearer's body;

3) placing two sleeves each extending away from respective opposing side body portions upon the wearer's body; and 4) placing two upper back flaps together each extending away from the back body pieces and toward each other so as to engage the bib upon the wearer's body.

15. The method of claim 14 wherein step 3) comprises:

i) defining a-sleeve end having a hook-and-loop fastener of each of the sleeves; and ii) adjusting a sleeve opening of each of the sleeve ends with the hook-and-loop fastener.

16. The method of claim 14 wherein step 4) comprises:

i) defining a hook-and-loop fastener formed between the two upper back flaps; and ii) adjusting the engagement between the two upper back flaps with the hook-and-loop fastener.

17. The method of claim 13 wherein step h) comprises:

1) opening the second pouch in an opposite direction than the first pouch; and 2) receiving the folded upper body region within the opened second pouch.

18. A method of manufacturing a bib, the method comprising the steps of:

a) obtaining a template having upper and lower template regions;

b) forming a first longitudinal template region of the template;

c) forming a second longitudinal template region of the template to have a peripheral geometry similarly sized and configured as the first longitudinal template region when superimposed thereupon;

d) defining an inner template portion, an outer template portion, an intermediate template portion and a hem template portion about the lower template region;

e) placing the outer template portion over the inner template portion;

f) placing the intermediate template portion and the hem template portion underneath the outer template portion;

g) superimposing the upper and lower template regions with each other; and h) engaging the respective peripheral geometries of the first and second longitudinal template regions to manufacture the bib.

19. The method of claim 18 wherein steps b) and c) comprise cutting the template to form the first and second longitudinal template regions with respective peripheral geometries.

20. The method of claim 18 wherein subsequent to step f), the method comprises:

1) stitching the intermediate and hem template portions to the outer template portion; and wherein step h) comprises:

1) stitching the respective peripheral geometries of the first and second longitudinal template regions.

* * * * *